US005240073A

United States Patent [19]

Bustamante et al.

[11] Patent Number: 5,240,073

[45] Date of Patent: Aug. 31, 1993

[54] DOWN-HOLE CONCENTRIC CHAMBER GAS SEPARATOR AND METHOD

[75] Inventors: Asdrubal Bustamante, El Tigre; Jesus R. Gonzalez, Santome, both of Venezuela

[73] Assignee: Corpoven, S.A., Caracas, Venezuela

[21] Appl. No.: 863,018

[22] Filed: Apr. 3, 1992

[51] Int. Cl.[5] ..... E21B 43/38

[52] U.S. Cl. ..... 166/265; 166/105.5; 166/115; 166/242

[58] Field of Search ..... 166/105.5, 242, 54.1, 166/51, 278, 115, 265

[56] References Cited

U.S. PATENT DOCUMENTS

| | | | |
|---|---|---|---|
| 405,200 | 6/1889 | Chapman | 166/205 X |
| 2,749,988 | 6/1956 | West | 166/51 X |
| 3,128,719 | 4/1964 | Jongbloed et al. | 166/105.5 |
| 3,627,046 | 11/1969 | Miller | 166/51 X |
| 4,074,763 | 2/1978 | Stevens | 166/105.5 X |
| 4,676,308 | 6/1987 | Chow et al. | 166/105.5 X |

*Primary Examiner*—Stephen J. Novosad
*Attorney, Agent, or Firm*—Bachman & LaPointe

[57] ABSTRACT

A down-hole separator for a production well drilled in a producing formation has a first tube having a first end and a second end, the first end being adapted for connection to an end of a production tubing of the production well, an outer annular space being defined between the first tube and a casing string of the production well; a second tube, having a smaller diameter then the first tube, and being disposed within the first tube, an inner annular space being defined between the second tube and the first tube, the second tube having an inlet end and an outlet end, the outlet end being turned at an angle relative to a longitudinal axis of the second tube and communicating with the outer annular space, the inlet end passing sealingly through the second end of the first tube to communicate with the producing formation, the first tube having perforations at a point below the outlet end of the second tube to allow communication between the outer annular space and the inner annular space.

17 Claims, 1 Drawing Sheet

DOWN-HOLE CONCENTRIC CHAMBER GAS SEPARATOR AND METHOD

BACKGROUND OF THE INVENTION

The present invention relates to a down-hole separator for a production well and, more particularly to a concentric chamber separator through which flowing hydrocarbons are passed from a producing formation in order to separate gas from liquid hydrocarbons prior to production of the liquid hydrocarbons through a production tubing.

As hydrocarbons are produced from hydrocarbon producing wells, substantial amounts of gas, which are in solution with the oil due to the temperature and pressure conditions of the formation, come out of solution during the course of their transport to the surface. Large amounts of such gas can cause inefficient operation of and damage to pumps which are designed primarily for moving liquids. Furthermore, gas can collect in various places along the production line to create a condition known as "gas lock" which can effectively block the gravity flow of oil. This "gas lock" can also cause significant damage to pumps located along the production line.

Various devices have been proposed whereby down-hole separation of oil and gas is accomplished through manipulation of the difference in density between the two fluids.

U.S. Pat. No. 3,386,390 discloses a gas anchor for down-hole separation. Separation is accomplished through a concentric chamber attachment that extends from the bottom of a tubing.

U.S. Pat. No. 4,074,763 discloses a down-hole separator which employs centrifugal force to achieve the desired separation of gas from oil.

U.S. Pat. No. 4,676,308 discloses a down-hole separator located in a production tube wherein both oil and gas drawn into the production tube are circulated through an annulus between the tube and well casing where gas rises to the surface and oil re-enters the tube.

Devices as those described above encounter problems in operation when the oils being produced are of medium or heavier weight due to increased viscosity which interferes with liberation of gas to be separated. When formation pressures are low, turbulence sufficient to separate gas from oil, and particularly heavy oil, is not achieved. This is in part due to the fact that the oil and gas are originally produced either into the tubing or the annular space which both have relatively large flow area. Hence, the flow velocities of the oil/gas fluids may not be sufficient to provide the desired degree of separation.

Accordingly, it is a principal object of the present invention to provide a down-hole separator which will remove substantial amounts of gas from a hydrocarbon stream before the hydrocarbon stream passes through a down-hole pump.

It is a further object of the present invention to provide a down-hole separator having an outside diameter equal to or less than the outside diameter of the production tubing to facilitate production operations which must be carried out in the annular space of the producing well.

Further objects and advantages will become apparent to those skilled in the art after a consideration of the following drawings and detailed description of the invention.

SUMMARY OF THE INVENTION

The aforesaid objects and advantages are achieved by way of the present invention wherein a down-hole separator for a production well comprises a first tube having a first end and a second end, the first end adapted for connection to an end of a production tubing of the production well, the second end having a reduced inside diameter, an outer annular space being defined between the first tube and a casing string of the production well when the first tube is connected to the production tubing of the production well; and a second tube having a smaller diameter than the first tube and being disposed within the first tube, an inner annular space being defined between the second tube and the first tube, the second tube having an inlet end and an outlet end, the outlet end being turned at an angle relative to a longitudinal axis of the second tube and communicating with the outer annular space, the inlet end passing sealingly through the reduced inside diameter of the second end of the first tube to communicate with the producing formation, the first tube having perforations at a point below the outlet end of the second tube to allow communication between the outer annular space and the inner annular space.

The first tube of the down-hole separator may preferably include an upper joint member adapted for connection to the production tubing and having an aperture through which the outlet end of the second tube communicates with the outer annular space, a central tubular section attached to the upper joint member, and a lower joint member, attached to the central tubular section, the reduced inside diameter and perforations of the first tube being located in the lower joint member.

When separated gas from the separator is to be introduced into a gas flow line having a flow line pressure, the down-hole separator preferably further comprises a spacing tube to be disposed between the production tubing and the down-hole separator. The spacing tube has a length selected to provide desired pressure characteristics at the perforations of the first tube. This length is preferably selected to provide a column of fluid sufficient to balance the flow line pressure of the gas flow line.

BRIEF DESCRIPTION OF THE DRAWINGS

A detailed description of the preferred embodiments of the invention will now be given, with reference to the accompanying drawings, wherein.

DETAILED DESCRIPTION OF THE INVENTION

Figure 1:
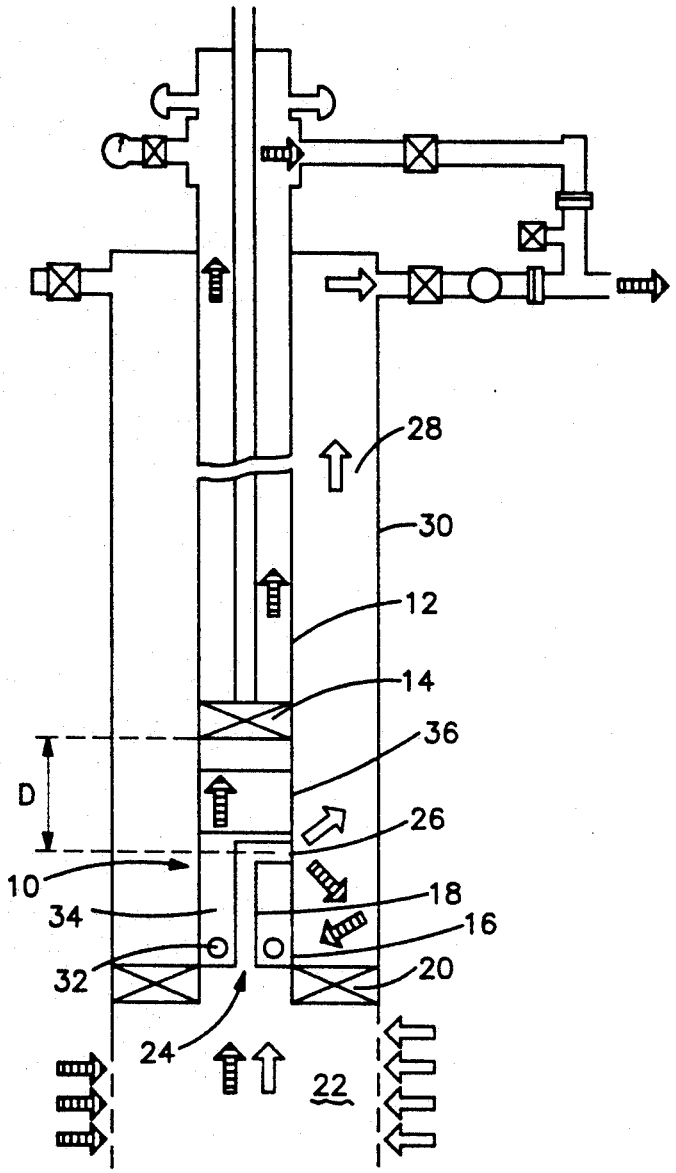
FIG. 1 is a schematic illustration of a down-hole separator, according to the invention, in its environment.

Referring to the drawings, FIG. 1 depicts a down-hole separator 10 in an environment of use. Separator 10 is connected to a tubing string 12 and serves to separate gas from oil being produced before the oil passes through pump 14.

The separator 10 comprises a first tube 16 and a second tube 18. Second tube 18 is smaller in diameter than first tube 16 and is disposed inside first tube 16.

When installed, separator 10 is set into a packer 20, which directs flow from well bore 22 into inlet 24 of second tube 18. The flow of oil and gas from well bore 22 is depicted by shaded arrows representing oil flow and non-shaded arrows representing gas flow.

Second tube 18 is turned at an angle of deflection 25 and communicates through outlet end 26 with an outer annular space 28 defined between tubing string 12 and casing 30. The diameter of second tube 18 is selected to provide acceleration and turbulence of the incoming oil and gas. The resultant acceleration and turbulence cause separation of oil and gas as described herein. Due to the aforesaid increased turbulence and velocity, oil and gas are separated in second tube 18, and exit from outlet end 26 into outer annular space 28. From this point, gas flows upwards to the surface through outer annular space 28 as shown by the non-shaded arrow of FIG. 1, while oil drops in outer annular space 28 where it is drawn through perforations 32 located in first tube 16. This oil, as shown by the shaded arrows, flows into an inner annular space 34 defined between first tube 16 and second tube 18. Oil is drawn through pump 14 and produced to the surface through tubing string 12.

It has been discovered, according to the invention, that the end use of gas produced through outer annular space 28 affects the operation of separator 10. More specifically, if the gas is to be introduced into a gas flow line (not shown), having a gas flow line pressure, the gas flow line pressure results in an increase in the pressure in outer annular space 28. Further, pressure in inner annular space 34 is reduced by suction of pump 14. This combination of increased pressure in outer annular space 28 and decreased pressure in inner annular space 34 results in a pressure differential across perforations 32 of first tube 16. This pressure differential causes both oil and gas to flow towards the perforations 32, thus precluding the desired separation. Accordingly, the gas flow line pressure must be compensated in order to balance the pressure differential at perforations 32 of first tube 16.

According to the invention, this additional pressure is compensated by a spacer 36, disposed between separator 10 and tubing string 12. Spacer 36 preferably has a length sufficient to provide a distance D between pump 14 and outlet end 26 of second tube 18. D is selected to provide an increased height of the column of fluid in inner annular space 34 which balances the gas flow line pressure and reduces the pressure differential at perforations 32. Such a spacer 36 is schematically depicted in FIG. 1 and is preferably any type of conventional tubular flow conductor which can be connected between the pump 14 at the end of tubing string 12 and down-hole separator 10.

In wells where separated gas is burned at the surface, no pressure is added to outer annular space 28 and no spacer 36 is needed.

Figure 2:
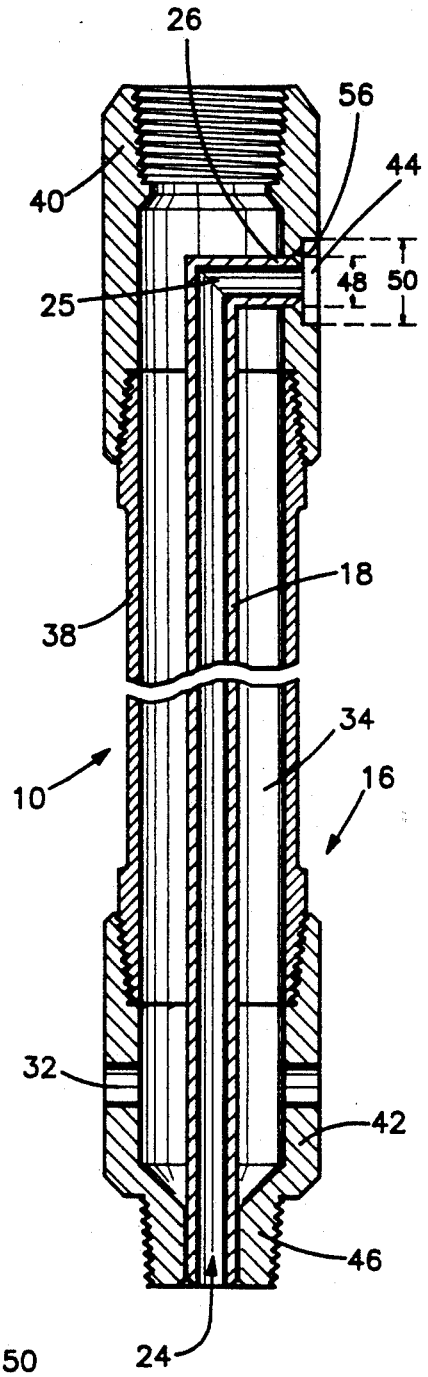
FIG. 2 is a cross sectional view of a preferred embodiment of the down-hole separator, according to the invention.

FIG. 2 shows the down-hole separator 10, according to the invention, in greater detail.

First tube 16 preferably comprises a flow conductor 38 having an upper joint 40 and a lower joint 42 affixed thereto, at either end, by any means known in the art, such as conventional thread means.

Upper joint 40 has an aperture 44 through which outlet end 26 of second tube 18 communicates with outer annular space 28. Upper joint 40 is also adapted for connection to tubing string 12, or spacer 38, if necessary, through any connection means known in the art, such as conventional thread means.

Lower joint 42 has perforations 32 which, as described previously, allow oil flow from outer annular space 28 to inner annular space 34. Lower end 46 of lower joint 42 preferably has a reduction in diameter wherein inlet end 24 of second tube 18 is sealably disposed to facilitate flow from well bore 22 (not shown in FIG. 2) to inlet end 24. It should be noted that second tube 18 may preferably be sealingly disposed in lower joint 42 through any means which would force flow from the well into inlet end 24 of second tube 18 by closing off the bottom end of first tube 16. Finally, lower end 46 of lower joint 42 is also preferably adapted for connection to packer 20 (not shown in FIG. 2) through any means known in the art.

Second tube 18, as previously described, has an inlet end 24 and an outlet end 26. Second tube 18 has a reduced diameter which is selected to provide acceleration to incoming fluid.

Second tube 18 is preferably selected having a flow diameter that will accelerate produced oil and gas sufficiently to obtain substantial separation at angle of deflection 25. It has been found that a flow area which accelerates oil and gas by a factor of 35, for example, yields the desired separation. The size of second tube 18 is also relevant to the size of inner annular space 34, which must be large enough to conduct flow of potentially heavy oils.

It should also be noted that angle of deflection 25 could be any angle affording a desired degree of separation, and may be a gradual bend rather than a sharp angle as shown in FIG. 2.

Figure 3:
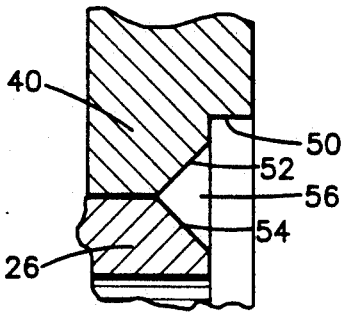
FIG. 3 is an enlarged view of a section of FIG. 2.

FIG. 3 shows a preferred embodiment wherein aperture 44 of first tube 16 is adapted to provide sealing interaction between first tube 16 and outlet end 26 of second tube 18 without any protuberences into outer annular space 28 which could interfere with operations that must be performed in outer annular space 28. According to this embodiment, aperture 44 has an inside diameter 48 and an outside diameter 50, and a beveled face 52 disposed therebetween. Outlet end 26 of second tube 18 also has a beveled end 54 which cooperates with beveled face 52 to provide a space or fillet 56 wherein welding operations, for example, can be conducted to affix second tube 18 to first tube 16, without any protuberance.

It should be noted that beveled structure such as in FIG. 3 could also be adapted to the connection of inlet end 24 of second tube 18 to lower end 46 of lower joint 42.

Returning to FIG. 1, the operation of down-hole separator 10 will be described in order to provide better understanding.

Oil and gas from well bore 22 are produced into separator 10 through inlet end 24 of second tube 18. The diameter of second tube 18 is selected so that the velocity of oil and gas flow is accelerated. The accelerated oil and gas pass through angle of deflection 25 and are separated. Separated oil and gas exit separator 10 through outlet end 26 of second tube 18 and enter outer annular space 28. Gas flows by gravity upwards through outer annular space 28 to the surface where it is burned or introduced into a gas flow line for transportation and use. Oil falls in outer annular space 28 and is drawn back into down-hole separator 10 through perforations 32 in first tube 16. Oil is pulled by pump 14 upwards through inner annular space 34 and produced through spacer 56, if necessary, and tubing string 12 to the surface.

As can be seen, the separator according to the invention provides effective down-hole separation of gas from oil before the oil is produced through various pumping and flow stations. This separation helps to avoid gaslock and damage to pumps, and provides more efficient operation of the producing well in which the separator according to the invention is used. It is to be understood that the invention is not limited to the illustration described and shown herein, which are deemed to be merely illustrative of the best modes of carrying out the invention, and which are susceptible to modification of form, size, arrangement of parts and details of operation. The invention rather is intended to encompass all such modifications which are within its spirit and scope as defined by the claims.

What is claimed is:

1. A down-hole separator for a production well drilled in a producing formation, comprising:

a first tube, having a first end and a second end, said first end being adapted for connection to an end of a production tubing of the production well, an outer annular space being defined between said first tube and a casing string of the production well when said first tube is connected to said production tubing of the production well;

a second tube, having a smaller diameter than said first tube and being disposed within said first tube, an inner annular space being defined between said second tube and said first tube, said second tube having an inlet end and an outlet end, said outlet end being turned at an angle relative to a longitudinal axis of said second tube and communicating with said outer annular space, and said inlet end passing sealingly through said second end of said first tube to communicate with the producing formation, said first tube having perforations at a point below said outlet end of said second tube to allow communication between said outer annular space and said inner annular space, whereby oil and gas are accelerated by said second tube and separator; and spacing means disposed between said production tubing and said second tube outlet end for selectively controlling the distance D between the second tube outlet end and a pump upstream of said second tube outlet end.

2. A down-hole separator according to claim 1, wherein said first tube comprises:

an upper joint member adapted for connection to said production tubing and having an aperture through which said outlet end of said second tube communicates with said outer annular space;

a central tubular section attached to said upper joint member;

a lower joint member, attached to said central tubular section, said reduced inside diameter and perforations of said first tube being located in said lower joint member.

3. A down-hole separator according to claim 2, wherein said lower joint member is adapted for connection to a packer set in said outer annular space of the well.

4. A down-hole separator according to claim 3, wherein said aperture of said upper joint member has an inner diameter which corresponds in size to said outlet end of said second tube and an outer diameter larger in size than said inner diameter, whereby said outlet end of said second tube can be anchored in said aperture without extending into said outer annular space.

5. A down-hole separator according to claim 4, wherein said inside diameter of said aperture and said outlet end of said second tube are bevelled to facilitate anchoring of said outlet end in said aperture.

6. A down-hole separator according to claim 1, wherein said outlet end of said second tube is turned at an angle of approximately 90°.

7. A down-hole separator according to claim 1, wherein separated gas is introduced into a gas flow line having a flow line pressure, the down-hole separator further comprising spacing means disposed between said production tubing and the down-hole separator, said spacing means having a length selected to provide desired pressure characteristics at said perforations of said first tube.

8. A down-hole separator according to claim 7, wherein said length of said spacing means is selected to provide a column of fluid sufficient to balance said flow line pressure.

9. A down-hole separator, comprising:

a first tube, having a first end and a second end;

a second tube, having a smaller diameter than said first tube and being disposed within said first tube, said second tube having an inlet end and an outlet end, said outlet end being turned at an angle relative to a longitudinal axis of said second tube and passing through a side wall of said first tube, and said inlet end passing sealingly through said second end of said first tube whereby said second end of said first tube is closed, said first tube having perforations at a point below said outlet end of said second tube wherein said first tube further includes an upper joint member having an aperture in which said outlet end of said second tube is mounted, a central tubular section attached to said upper joint member, and a lower joint member, attached to said central tubular section, said lower joint member having a reduced inside diameter whereby sealing connection with said inlet end of said second tube is provided, said perforations of said first tube being located in said lower joint member.

10. A down-hole separator according to claim 9, wherein said aperture of said upper joint member has an inner diameter and an outer diameter, said inner diameter corresponding in size to said outlet end of said second tube, and said outer diameter being larger in size than said inner diameter, whereby said outlet end of said second tube can be anchored in said aperture without extending therefrom.

11. A down-hole separator according to claim 10, wherein said inside diameter of said aperture and said outlet end of said second tube are bevelled to facilitate anchoring of said outlet end in said aperture.

12. A down-hole separator according to claim 9, wherein said outlet end of said second tube is turned at an angle of approximately 90°.

13. A down-hole separator according to claim 9, further comprising spacing means attached to a top of said first tube.

14. A method for separating a down-hole flow of oil and gas, comprising the steps of:

disposing a down-hole separator at a bottom end of a tubing string at a desired distance from a pump contained in the tubing string, the separator comprising a first tube, having a first end and a second end, a second tube, having a smaller diameter than said first tube and being disposed within said first tube, said second tube having an inlet end and an outlet end, said outlet end being turned at an angle relative to a longitudinal axis of said second tube and passing through a side wall of said first tube, and said inlet end passing sealingly through said second end of said first tube, said first tube having perforations at a point below said outlet end of said second tube;

selecting said desired distance to provide a desired pressure differential at said perforations of said first tube; and passing the flow through said down-hole separator.

15. A method according to claim 14, wherein said desired distance is selected to provide a column of fluid sufficient to compensate a pressure of a gas line to which separated gas is introduced.

16. A down-hole separator for a production well drilled in a producing formation, comprising:

a first tube, having a first end and a second end, said first end being adapted for connection to an end of a production tubing of the production well, an outer annular space being defined between said first tube and a casing string of the production well when said first tube is connected to said production tubing of the production well; and a second tube, having a smaller diameter than said first tube and being disposed within said first tube, an inner annular space being defined between said second tube and said first tube, said second tube having an inlet end and an outlet end, said outlet end being turned at an angle relative to a longitudinal axis of said second tube and communicating with said outer annular space, and said inlet end passing sealingly through said second end of said first tube to communicate with the producing formation, said first tube having perforations at a point below said outlet end of said second tube to allow communication between said outer annular space and said inner annular space, whereby oil and gas are accelerated by said second tube and separated wherein said first tube further includes an upper joint member having an aperture in which said outlet end of said second tube is mounted, a central tubular section attached to said upper joint member, and a lower joint member, attached to said central tubular section, said lower joint member having a reduced inside diameter whereby sealing connection with said inlet end of said second tube is provided, said perforations of said first tube being located in said lower joint member.

17. A down-hole separator for a production well drilled in a producing formation, comprising:

a first tube, having a first end and a second end, said first end being adapted for connection to an end of a production tubing of the production well, an outer annular space being defined between said first tube and a casing string of the production well when said first tube is connected to said production tubing of the production well; and a second tube, having a smaller diameter than said first tube and being disposed within said first tube, an inner annular space being defined between said second tube and said first tube, said second tube having an inlet end and an outlet end, said outlet end being turned at an angle relative to a longitudinal axis of said second tube and communicating with said outer annular space, and said inlet end passing sealingly through said second end of said first tube to communicate with the producing formation, said first tube having perforations at a point below said outlet end of said second tube to allow communication between said outer annular space and said inner annular space, whereby oil and gas are accelerated by said second tube and separated wherein separated gas is introduced into a gas flow line having a flow line pressure, the down-hole separator further comprising spacing means disposed between said production tubing and the down-hole separator, said spacing means having a length selected to provided desired pressure characteristics at said perforations of said first tube.

* * * * *